US006092948A

United States Patent [19]

Altfather

[11] Patent Number: 6,092,948

[45] Date of Patent: Jul. 25, 2000

[54] METHOD AND MECHANISM FOR SUPPORTING AND STACKING LIQUID INK PRINTED SHEETS

[75] Inventor: Kenneth W. Altfather, Fairport, N.Y.

[73] Assignee: Xerox Corporation, Stamford, Conn.

[21] Appl. No.: 09/343,499

[22] Filed: Jun. 30, 1999

[51] Int. Cl.[7] ..... B41J 11/58

[52] U.S. Cl. ..... 400/625; 400/624; 271/189

[58] Field of Search ..... 400/625, 624, 400/626, 630; 101/418, 419, 420, 426, 485; 271/189, 213, 161, 188, 209

[56] References Cited

U.S. PATENT DOCUMENTS

| | | | |
|---|---|---|---|
| 4,728,963 | 3/1988 | Rasmussen et al | 271/209 X |
| 4,794,859 | 1/1989 | Huseby et al. | 101/485 |
| 4,844,633 | 7/1989 | Greenberg | 271/189 |
| 4,849,774 | 7/1989 | Endo et al. | 346/140 R |
| 5,269,613 | 12/1993 | Olson et al. | 400/624 X |
| 5,536,000 | 7/1996 | Kelly | 271/189 |
| 6,027,269 | 2/2000 | Yoshida | 400/625 |

*Primary Examiner*—John S. Hilten
*Assistant Examiner*—Minh Chau
*Attorney, Agent, or Firm*—Tallam I. Nguti

[57] ABSTRACT

A method and mechanism are provided for supporting and stacking a liquid ink printed sheet moving along an in-track path and direction in a liquid ink printing system and having a flat, cross-track dimension "D1" defined by a first edge and a second and opposite edge of such sheet. The mechanism for the method includes an output tray defining and providing a stacking surface for holding the liquid ink printed sheet in a stack; and a first member having an edge supporting portion and an edge guiding portion for supporting and guiding the first edge of the liquid ink printed sheet, the first member being mounted at a first position having a first desired height distance above the stacking surface, and the first member extending along the in-track path and direction. The mechanism for the method also includes a second member having an edge supporting portion and an edge guiding portion for supporting and guiding the second and opposite edge of such sheet, the second member being mounted at a second position having the first desired height distance above the stacking surface, and being spaced a cross-track distance "D3", that is less than "D1", from the first member, and the second member extending along the in-track path and direction. Finally, the mechanism for the method also includes a system for rotating the first member and the second member for buckling the liquid ink printed sheet downwardly through the first desired height distance, and through the cross-track distance "D3" onto the stacking surface of the output tray.

9 Claims, 3 Drawing Sheets

METHOD AND MECHANISM FOR SUPPORTING AND STACKING LIQUID INK PRINTED SHEETS

BACKGROUND OF THE INVENTION

The present invention relates generally to liquid ink recording apparatus or ink jet printers, and more particularly relates to a method and apparatus in such a recording apparatus for supporting and stacking liquid ink printed sheets.

Liquid ink printers of the type frequently referred to either as continuous stream or as drop-on-demand, such as piezoelectric, acoustic, phase change wax-based or thermal, have at least one printhead from which droplets of ink are directed towards a recording sheet. Within the printhead, the ink is contained in a plurality of channels. For a drop-on-demand printhead power pulses cause the droplets of ink to be expelled as required from orifices or nozzles at the end of the channels.

In a thermal ink-jet printer, the power pulses are usually produced by formation and growth of vapor bubbles on heating elements or resistors, each located in a respective one of the channels, which are individually addressable to heat and vaporize ink in the channels. As voltage is applied across a selected resistor, a vapor bubble grows in the associated channel and initially expels the ink therein from the channel orifice, thereby forming a droplet moving in a direction away from the channel orifice and towards the recording medium where, upon hitting the recording medium, a dot or spot of ink is deposited. Following collapse of the vapor bubble the channel is refilled by capillary action, which, in turn, draws ink from a supply container of liquid ink. Operation of a thermal ink-jet printer is described in, for example, U.S. Pat. No. 4,849,774.

The ink jet printhead may be incorporated into either a carriage type printer, a partial width array type printer, or a page-width type printer. The carriage type printer typically has a relatively small printhead containing the ink channels and nozzles. The printhead can be sealingly attached to a disposable ink supply cartridge and the combined printhead and cartridge assembly is attached to a carriage which is reciprocated to print one swath of information (equal to the length of a column of nozzles), at a time, on a supported, stationary recording medium, such as paper or a transparency.

After the swath is printed, the paper is stepped a distance equal to the height of the printed swath or a portion thereof, so that the next printed swath is contiguous or overlapping therewith. This procedure is repeated until an entire page is printed. In contrast, the page width printer includes a stationary printhead having a length sufficient to print across the width or length of a supported sheet of recording medium at a time. The supported recording medium is continually moved past the page width printhead in a direction substantially normal to the printhead length and at a constant or varying speed during the printing process.

In either case, the substrate or sheet is supported on a supporting assembly that comprises a platen. Typically, the sheet supporting platen consists of a flat surface, or of a rotating hollow drum, that in either case, has a back surface, and a front surface that has an area which is large enough to support up to a legal size sheet, with border areas left over. In some ink jet printers, the platen includes a heating device to attempt to dry the ink images. However, in a lot of small ink jet printers or systems including an ink jet printing step, there is no such heater.

Ordinarily however, as such ink jet printers are made faster and faster, the liquid ink images printed onto the supported sheet are usually not fully dry by the time the sheet exits the printer. Such wet images on exiting the printer will then to smear or offset if the exiting sheet comes into contact with a previously printed sheet in the output tray. Additionally, such printers are also being made smaller and smaller, thus providing less and less space for large trays or complicated pre-drop sheet handling mechanisms.

A known pre-drop sheet handling mechanism is disclosed for example in U.S. Pat. No. 4,794,859. The disclosed mechanism includes opposed movable rails thatt are associated with opposed walls with no vertical sheet guides which can lead to sheet misaligment; each rail includes a return spring, a pressurable wing member, a pivot on the floor of the sheet support tray outwardly of a sheet support area thus requiring a relatively large tray floor; and a recess in a wall for receiving the rail in an opened position, all in all making the mechanism bulky, complicated, and costly.

There is therefore a need for a relatively small, simple and low cost system that can handle such sheets with wet or likely wet images so as to prevent such undesirable smearing or ink offset.

SUMMARY OF THE INVENTION

In accordance with one aspect of the present invention, there is provided a method of supporting and stacking a liquid ink printed sheet moving along an in-track path and direction and having a flat, cross-track dimension "D1" defined by a first edge and a second edge thereof. The method includes the steps of providing a stacking surface having a cross-track dimension "D2" for receiving the liquid ink printed sheet onto a stack; positioning a pair of support members at a spaced cross-track distance "D3", that is less than "D1", with "D3" being centered in the cross-track direction and having a desired vertical distance "H" above the stacking surface; supporting and guiding the moving liquid ink printed sheet on the support members to a desired in-track position over the stacking surface; and downwardly buckling the moving liquid ink printed sheet at the desired in-track position and through the desired vertical distance "H" by automatically pushing the first edge and the second edge of such sheet inwardly from their flat cross-track dimension "D1" to a buckled cross-track dimension less than "D3", thus allowing time for printed liquid ink on such sheet to dry, and the sheet to fall through the pair of support members onto the stacking surface.

In accordance with another aspect of the present invention, there is provided mechanism for supporting and stacking a liquid ink printed sheet moving along an in-track path and direction in a liquid ink printing system and having a flat, cross-track dimension "D1" defined by a first edge and a second and opposite edge of such sheet. The mechanism includes an output tray defining a stacking surface for holding the liquid ink printed sheet in a stack; and a first member having an edge supporting portion and an edge guiding portion for supporting and guiding the first edge of the liquid ink printed sheet. The first member is mounted at a first position having a first desired height distance above the stacking surface, and extends along the in-track path and direction. The mechanism also includes a second member having an edge supporting portion and an edge guiding portion for supporting and guiding the second and opposite edge of such sheet. The second member is mounted at a second position having the first desired height distance above the stacking surface, extends along the in-track path and direction, and is spaced a cross-track distance "D3", that is less than "D1", from the first member.

Finally, the mechanism includes a system for rotating the first member and the second member for buckling the liquid ink printed sheet downwardly through the first desired height distance, and through the cross-track distance "D3" onto the stacking surface of the output tray.

BRIEF DESCRIPTION OF THE DRAWINGS

In the detailed description of the invention presented below, reference is made to the drawings in which.

DETAILED DESCRIPTION OF THE INVENTION

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Figure 1:
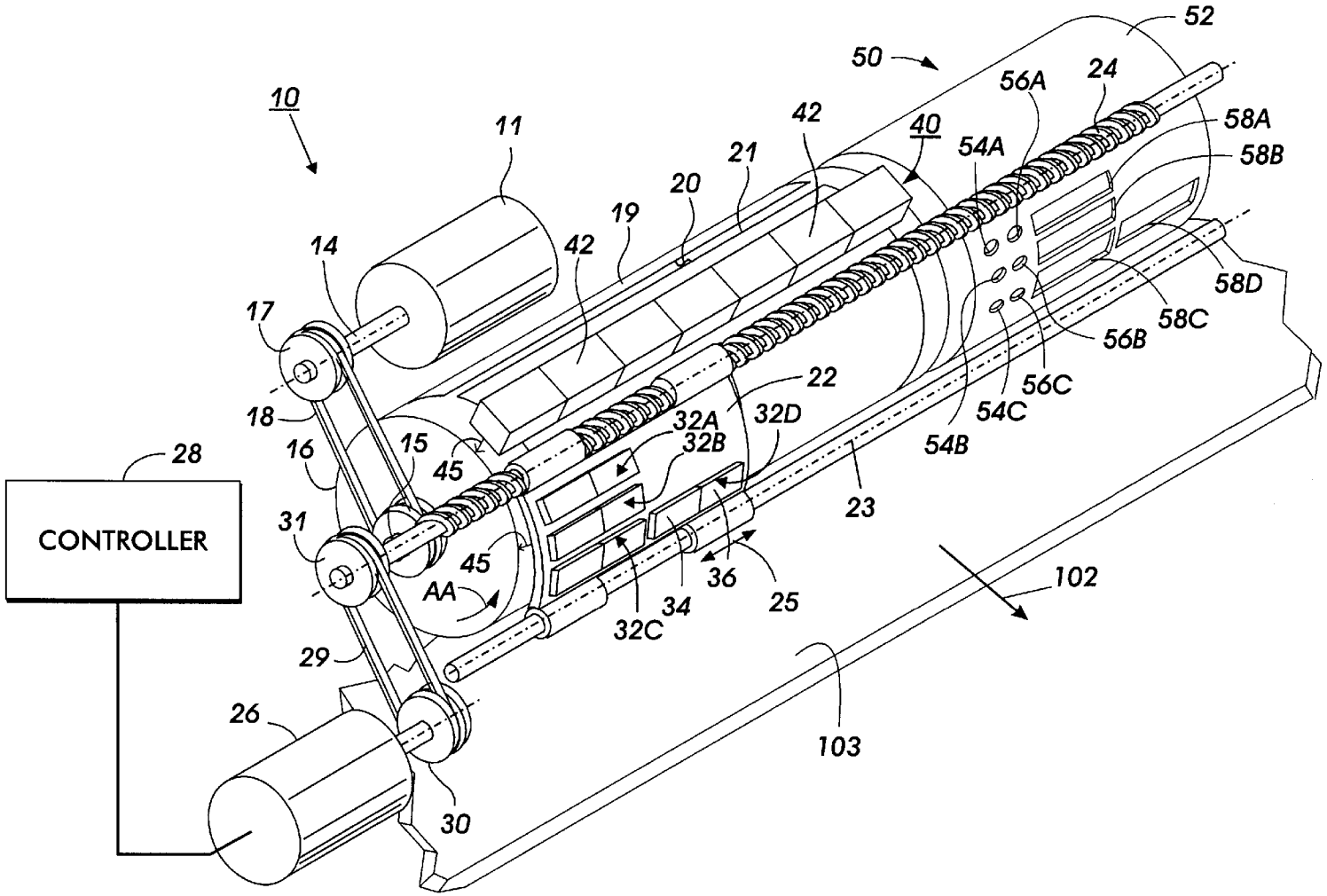
FIG. 1 illustrates a partial perspective view of an ink jet printing apparatus including the mechanism for supporting and stacking liquid ink printed sheets in accordance with the present invention.

Referring now to FIG. 1, the essential components of a printing apparatus or printer, generally designated 10, are illustrated. As shown, the outside covers or case and associated supporting components of the printing apparatus 10 are omitted for clarity. The essential components of the printing apparatus 10 include a motor 11 connected to a suitable power supply (not shown) and arranged with an output shaft 14 parallel to an axis 15 of a rotatable cylindrical drum 16 of a supporting assembly 60. A pulley 17 permits direct engagement of the output shaft 14, to a drive belt 18 for enabling the drum 16 to be continuously rotationally driven by the motor 11 in the direction of an arrow AA at a predetermined rotational speed.

A recording medium such as a sheet of paper or a transparency 19 (letter size or legal size) is placed over an outer surface 20 of the drum 16, with its leading edge 21 attached to the surface 20. Typically, the sheet is attached to the drum 16 either by the application of a vacuum, using holes in the drum 16 (not shown), or by other means of holding the sheet to the drum, for example, electrostatic means. In operation, as the drum 16 with a sheet 19 attached thereto rotates, it moves the sheet 19 with it past a printhead carriage 22.

The printhead carriage 22 is supported for example by a lead screw 24 that is mounted so that its axis is parallel to the axis 15 of the drum 16. Additionally, it is supported by fixed bearings (not shown) which enable it (the carriage 22) to be capable of slidably translating axially. A carriage rail 23 provides further support for the carriage 22 as it moves in the direction of arrow 25, that is perpendicular to the moving direction of the sheet 19. A second motor 26, such as a stepper motor or other positioning mechanism, which is controlled by a controller 28, drives the lead screw 24 with a second belt 29. As shown, the belt 29 is connected to a clutch 30, and to another clutch 31 that is attached to the lead screw 24 for movement thereof.

The printer 10, for example, includes printhead partial width arrays 32 that are each filled or charged with printing ink. The printhead partial width arrays 32 comprise a first partial width array printbar 32A, a second partial width array printbar 32B, a third partial width array printbar 32C, and a fourth partial width array printbar 32D. Each printbar 32A–32D as shown includes at least a printhead 34, or as preferred here, two printheads, a first printhead 34 and a second printhead 36 that are butted together to form such printbar.

Each of the printheads 34 and 36 includes several hundred or more channels and nozzles which in operation can be fired sequentially. In operation the partial width arrays 32, when charged or filled with ink, can be moved in the direction of arrow 25 for printing on the sheet. When filled with ink as such, the first, second and third partial width array printbars 32A–32C, respectively, will each contain ink of one of the colors cyan, magenta or yellow, for color printing. The fourth partial width array printbar 32D will contain black ink when necessary, especially when needed for printing graphics.

In addition to the partial width arrays 32, the printer 10 may also include a full-width array or pagewidth printbar 40 that is also filled or charged with printing ink. The pagewidth printbar 40 is supported by an appropriate support structure (not shown) above the drum 16 for printing on the recording medium when filled or charged with printing ink. The pagewidth printbar 40 has a length sufficient to print across the entire width (or length) of the recording medium during a single pass of the recording medium beneath the printbar. The printbar 40 as shown, includes a plurality of printhead units 42 that are affixed to a supporting member (not shown) in an abutted fashion. Alternatively, individual printhead units 42 may be spaced from one another by a distance approximately equal to the length of a single printhead subunit and bonded to opposing surfaces of the supporting member.

In each case, a front or forward facing edge of each printhead unit 34, 36 and 42, contains liquid droplet ejecting orifices or nozzles which can in operation, eject ink droplets along a trajectory 45 (FIG. 1), which is substantially perpendicular to the surface of a recording medium. As is well known, each printhead contains heating elements and printed wiring boards (not shown). The printed wiring boards contain circuitry required to interface and cause the individual heating elements in the printhead units to eject liquid (e.g. ink) droplets from the nozzles. While not shown, the printed wiring boards are connected to individual contacts contained on the printhead units via a commonly known wire bonding technique. The data required to drive the individual heating elements is supplied from an external system by a standard printer interface, modified and/or buffered by a printer controller or micro processor 28.

The printer controller 28 for example includes a basic image processing system for receiving and processing an electronic representation of a document or image in a format related to the physical characteristics of the device, from an image input source or terminal. Typical image input sources or terminals include a scanner, a computer image generator, such as a personal computer, and an image storage device. The electronic digital data signals, transmitted through the image processing unit are processed for suitable reproduction by the printer 10 pixel by pixel and one swath at a time.

Thus after one swath is printed, the paper is stepped a distance equal to the height of the printed swath or a portion thereof, so that the next printed swath is contiguous or overlapping therewith. This procedure is repeated until an entire page is printed. In the case of a page width printer that includes a stationary page width array printhead, the supported recording medium is continually moved past the page width array printhead in a direction substantially normal to the printhead length and at a constant or varying speed during the printing process. This too is continued until an entire page is printed. In either case, after each page or sheet is printed as above, it is then moved towards the mechanism 100 for supporting and stacking in accordance with the method of the present invention (to be described in detail below).

Referring still to FIG. 1 however, the printer or printing apparatus 10 preferably includes a maintenance system 50 located at one end of the drum 16 for preventing the nozzles in particular from drying out during idle periods. The maintenance system 50 includes assemblies which provide wet wiping of the nozzles of the printheads 32 and 34 as well as vacuuming of the same printheads for maintenance thereof. Wet wipers and vacuuming of nozzles typically include a fluid applicator and vacuum means that are located within a stationary drum housing 52 and extend through a plurality of apertures 54A, 54B and 54C when necessary to provide maintenance functions. When the printhead carriage moves to the maintenance position, the wet wipers apply a fluid to the ink jet nozzles such that any dried ink, viscous plugs or other debris is loosened on the front face of the ink jet printbars. Once the debris has been sufficiently loosened, a plurality of vacuum nozzles each extending through a plurality of vacuum nozzle apertures 56A–56C vacuum away any of the cleaning fluid as well as any debris loosened thereby.

Thus once a printing operation has been completed and any cleaning of the printbars has been completed, if necessary, the carriage 22 is moved into position above another plurality of apertures 58A–58D. A plurality of capping members disposed within the housing 50, are moved into contact with the front faces of the printbars 32 and 34 through the apertures 58A–58D to thereby cap nozzles of the printheads in order to substantially prevent any ink which has been collected in the nozzles of the printheads from drying out.

Referring now to FIGS. 1–4, structural and functional details of the mechanism 100 and method of the present invention, are illustrated. As shown, the mechanism 100 is suitable for supporting and stacking a liquid ink printed sheet 19 moving along an in-track path and direction defined in part by a portion of a machine frame 103, and shown by arrow 102. The printed sheet 19 has a flat, cross-track dimension "D1" defined by a first edge 104 and a second and opposite edge 106 of such sheet. The mechanism 100 includes an output tray 108 defining a stacking surface 110 having a cross-track dimension "D2", for holding the liquid ink printed sheet 19 in a stack 113. The mechanism 100 also includes a first member 112 having an edge supporting portion 114 and an edge guiding portion 116. The first member 112 is rotatably mounted at a first position 120 having a first desired height distance "H1" above the stacking surface 110. The first member 112 as shown extends along the in-track path and direction (102), for supporting and guiding the first edge 104 of the liquid ink printed sheet 19.

The mechanism 100 also includes a second member 122 having an edge supporting portion 124 and an edge guiding portion 126. The second member 122 as shown is rotatably mounted at a second position 130 which also has the first desired height distance "H1" above the stacking surface 110. Importantly, the second member 122 as supported is spaced a cross-track distance "D3", that is less than "D1", from the first member 112. As can be seen, the second member 122 also extends along the in-track path and direction (102) for supporting and guiding the second and opposite edge 106 of the printed sheet. Finally, the mechanism 100 includes a system 132 for rotating inwardly (arrows 131, 133) the first member 112, and the second member 122, in their mounted positions for buckling the liquid ink printed sheet 19 downwardly through the first desired height distance "H1", and partially through the cross-track distance "D3" onto the stack 113 of sheets, or onto the stacking surface 110 of the output tray 108 (when tray is empty).

As further shown, the edge guiding portion 116 of the first member 112, relative to the second member 122, is on the one hand formed at a distal point 134 (FIG. 2) on the edge supporting portion 114 of the first member 112. On the hand, the edge guiding portion 126 of the second member 122, relative to the first member 112, is formed at a distal point 136 (FIG. 2) on the edge supporting portion 124 of the second member 122. Advantageously, each edge supporting portion 114, 124 of the first member 112 and the second member 122, respectively includes a convex sheet edge supporting surface 138, 140, and each edge guiding portion 116, 126 thereof is formed at a distal point 134, 136 on each of the convex sheet edge supporting surfaces 138, 140.

Figure 2:
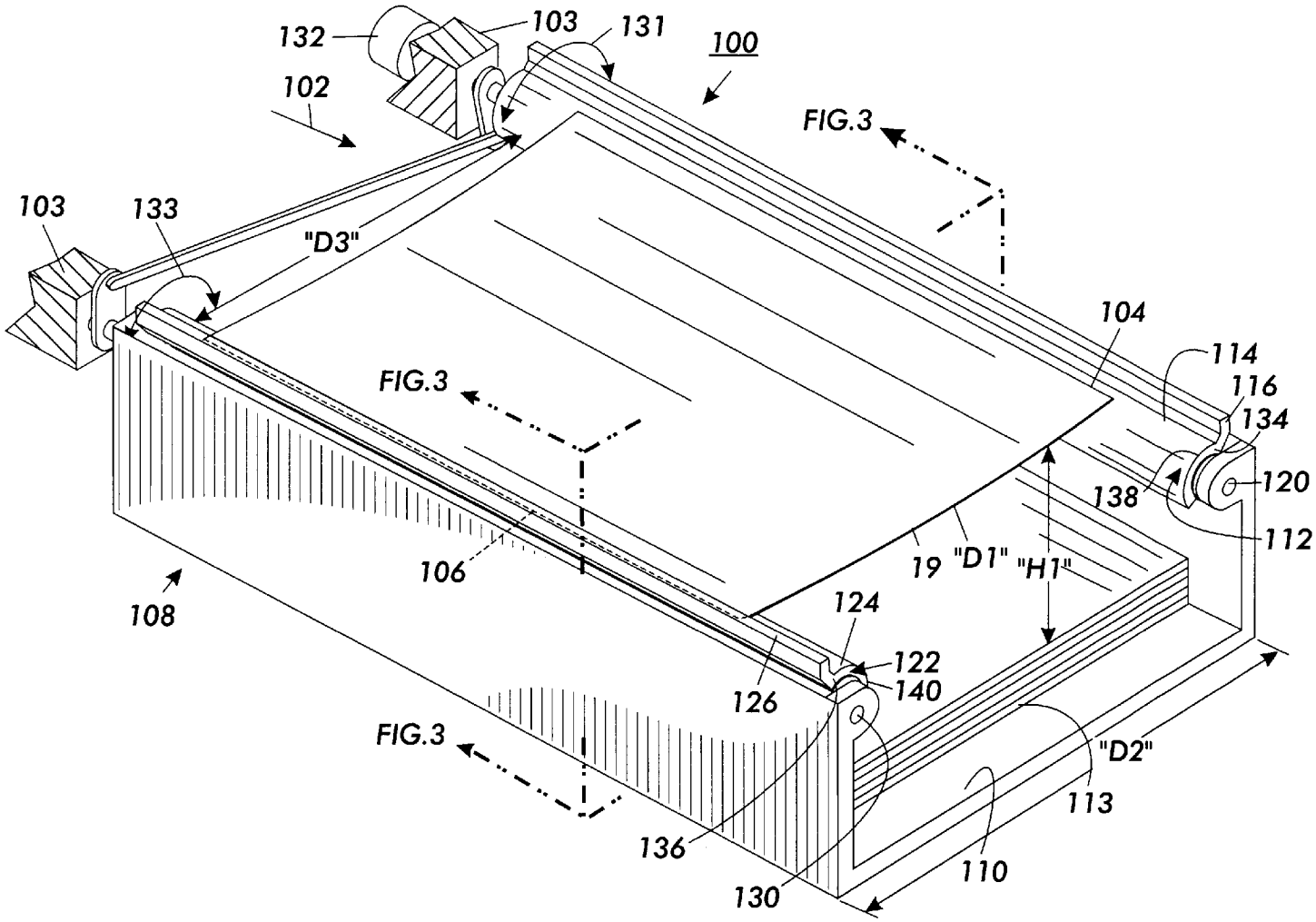
FIG. 2 is a perspective illustration of mechanism of FIG. 1.
Figure 3:
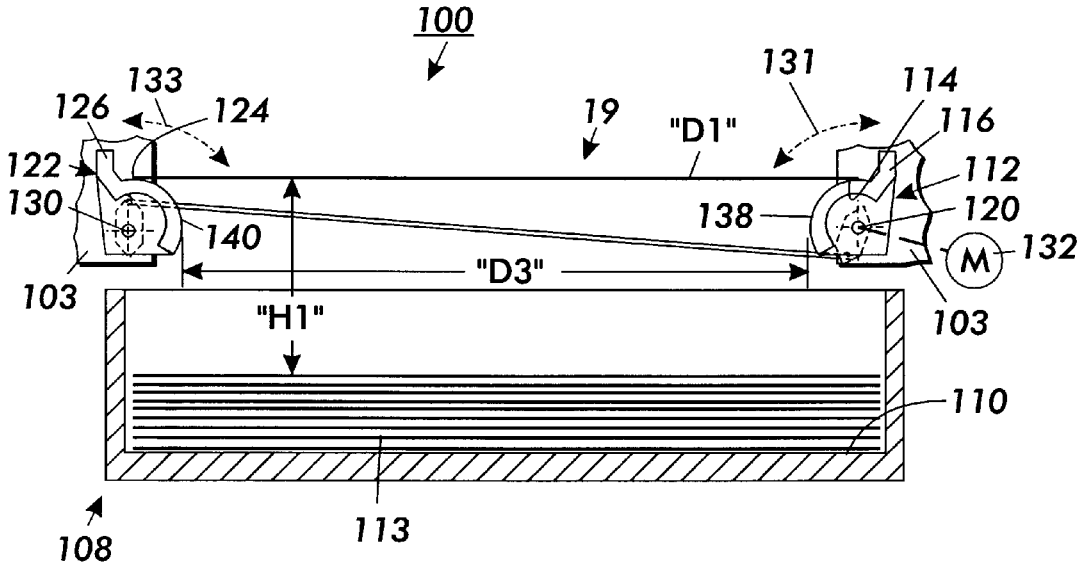
FIGS. 3–4 are illustrations of the working of mechanism of FIG. 2 in accordance with the present invention.
Figure 4:
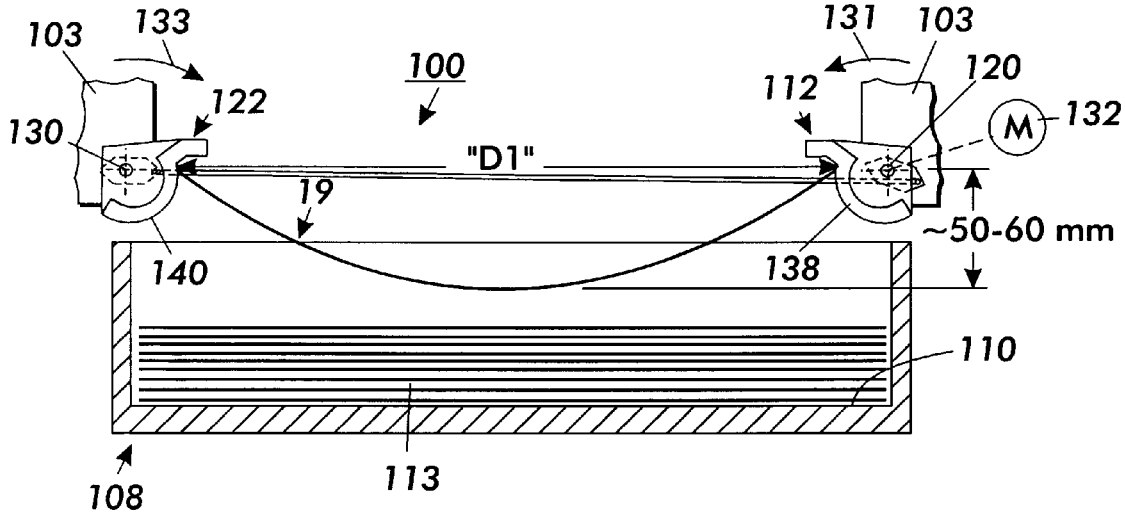

Referring in particular to FIGS. 2–4, the method of the present invention is suitable for supporting and stacking a liquid ink printed sheet 19 that is moving along an in-track path and direction (102) and has a flat, cross-track dimension "D1" defined by the first edge 104 and a second edge 106 thereof. The method includes the steps of providing a stacking surface 110 having a cross-track dimension "D2" for receiving the liquid ink printed sheet 19 onto a stack; positioning a pair of support members 112, 122 at a spaced cross-track distance "D3", that is less than "D1", and such that "D3" is centered in the cross-track direction (102). As positioned, the support members 112, 122 each have a desired vertical distance "H1" above the stacking surface 110.

The method next includes the steps of supporting and guiding the moving liquid ink printed sheet 19 on the support members 112, 122 to a desired in-track position directly over the stacking surface 110; and of downwardly buckling the moving liquid ink printed sheet 19, at the desired in-track position, and through the desired vertical distance "H1", by automatically pushing the first edge 104 and the second edge 106 of such sheet inwardly from their flat cross-track dimension "D1" to a buckled cross-track dimension less than "D3".

As such, by supporting and guiding the sheet as above, advantageously affords and allows time for the printed liquid ink on such sheet to dry before the sheet is pushed as above, through the pair of support members 112, 122 onto the stacking surface 110. The positioning step further entails positioning a pair of support members 112, 122 that each have a substantially horizontal rail like support surface 114 and an edge guiding vertical portion 116. The downwardly buckling step includes holding or retaining the first edge 104 and the second edge 106 with an inwardly slanted (convex) member 138 that is connected to the vertical portion 116, while simultaneously pushing the first edge 104 and second edge 106 inwardly towards each other.

Thus in accordance with the method of the present invention, a just printed or "wet" printed sheet 19, can be advantageously supported over the output tray 108 in order to allow time for the wet ink thereon to dry before allowing the sheet to drop softly onto the tray 108. As disclosed above, the mechanism 100 of the present invention advantageously operates to buckle the sheet 19 in its center instead of lifting its wings or edges. As such, wet images exiting the ink jet printer 10 will not smear or offset ink if the sheet 19 comes into contact with a previously printed sheet in the output tray.

Accordingly, as shown FIGS. 2–4, the mechanism 100 includes the output tray 108 that contains two sheet supporting and guiding members in the form of semi-cylindrical rails 112, 122 that receive and support an exiting sheet 19 above previously printed sheets in the tray 108. Each support member or cylindrical rail, 112, 122 also contains a raised rib or portion 114, 124 that is initially vertical so as to act as an edge guiding portion 116, 126 as the printed sheet 19 is advanced from the printing area of the printer 10 to the holding or output area over the tray 108. As the sheet 19 advances, it is supported near its edges 104, 106 by the semi-cylinderical rails or supporting and guiding members 112, 122. Naturally, the sheet will tend to start to buckle downwardly in its unsupported center. Thus at the completion of printing each sheet, the trail edge of the sheet leaves the printing platen exit nip and is pushed fully onto the rails or support members 112, 122. The support members or cylindrical rails 112, 122 are subsequently rotated inwardly such that the previously vertical ribs or guiding portions 116, 126 engage the sheet edges 104, 106 thus pushing them closer together and causing further downward buckling of the supported sheet 19. When the ribs or guiding portions 114, 124 are rotated to where they approach a horizontal position (FIG. 4), the linear width D1' of the buckled sheet 19 now equals the separation D3 of the rail edges, and the sheet 19 falls through the rails onto the output tray 108.

A key distinction between this approach and that described in the prior art is that the rails 112, 122 do not retract. Instead, they merely rotate cleanly and neatly in their mounted positions 120, 130, and the sheet 19 is forced to buckle until its width D1' fits between the two rails 112, 122. Advantageously, one rail or both rails 112, 122 can be adjusted inwardly or outwardly in order to compensate for various paper width sizes different from "D1". System 132 for rotating the rails 112, 122 can be motor driven and include a flexible cable or similar device.

In a typical implementation of the present invention, the rails 112, 122 might be separated by a distance "D3" of about 175 mm for handling typical letter size sheets. Thus, a letter sized sheet fed short edge (216 mm) onto the rails would be dropped when its effective width is reduced to approximately 175 mm by buckling in accordance to the present invention. To accomplish this, the rail rotation would buckle the sheet a linear distance of approximately 50 mm. Ideally, the sheet would not touch the output stack of prints on the output tray 108 until it has dropped lightly onto the stack. This means that the top of the output stack or sheet supporting surface 108 must be located a sufficient height distance "H1" below the rails. It has been found that such a height distance "H1" is best when it roughly approximates 50–60 mm.

Thus it can be seen that there has been provided a method and mechanism are provided for supporting and stacking a liquid ink printed sheet moving along an in-track path and direction in a liquid ink printing system and having a flat, cross-track dimension "D1" defined by a first edge and a second and opposite edge of such sheet. The mechanism for the method includes an output tray defining and providing a stacking surface for holding the liquid ink printed sheet in a stack; and a first member having an edge supporting portion and an edge guiding portion for supporting and guiding the first edge of the liquid ink printed sheet, the first member being mounted at a first position having a first desired height distance above the stacking surface, and the first member extending along the in-track path and direction. The mechanism for the method also includes a second member having an edge supporting portion and an edge guiding portion for supporting and guiding the second and opposite edge of such sheet, the second member being mounted at a second position having the first desired height distance above the stacking surface, and being spaced a cross-track distance "D3", that is less than "D1", from the first member, and the second member extending along the in-track path and direction. Finally, the mechanism for the method also includes a system for rotating the first member and the second member for buckling the liquid ink printed sheet downwardly through the first desired height distance, and through the cross-track distance "D3" onto the stacking surface of the output tray.

What is claimed is:

1. In a liquid ink printing system, a method of supporting and stacking a liquid ink printed sheet moving along an in-track path and direction and having a flat, cross-track dimension "D1" defined by a first edge and a second edge thereof, the method comprising the steps of:

(a) providing a stacking surface having a cross-track dimension "D2" for receiving the liquid ink printed sheet onto a stack;

(b) positioning a pair of support members at a spaced cross-track distance "D3", less than "D1", "D3" being centered in the cross-track direction, and having a desired vertical distance "H" above the stacking surface;

(c) supporting and guiding the moving liquid ink printed sheet on the support members to a desired in-track position over the stacking surface; and (d) downwardly buckling the moving liquid ink printed sheet at the desired in-track position and through the desired vertical distance "H" by automatically pushing the first edge and the second edge of such sheet inwardly from their flat cross-track dimension "D1" to a buckled cross-track dimension less than "D3", thus allowing time for printed liquid ink on such sheet to dry, and the sheet to fall through the pair of support members onto the stacking surface.

2. The method of claim 1, wherein said positioning step comprises positioning a pair of support members each having a horizontal support surface and an edge guiding vertical portion.

3. The method of claim 2, wherein said downwardly buckling step includes retaining each of the first edge and the second edge with an inwardly slanted member connected to the vertical portion while pushing the first edge and second edge inwardly.

4. A mechanism in a liquid printing system for supporting and stacking a liquid ink printed sheet moving along an in-track path and direction and having a flat, cross-track dimension "D1" defined by a first edge and a second and opposite edge of such sheet, the mechanism comprising:

(a) an output tray defining a stacking surface for holding the liquid ink printed sheet in a stack;

(b) a first member having an edge supporting portion and an edge guiding portion, said first member being mounted at a first position having a first desired height distance above said stacking surface, and said first member extending along the in-track path and direction, for supporting and guiding the first edge of the liquid ink printed sheet;

(c) a second member having an edge supporting portion and an edge guiding portion, said second member being mounted at a second position having said first desired height distance above said stacking surface, and spaced a cross-track distance "D3" less than "D1" from said first member, and said second member extending along the in-track path and direction for supporting and guiding the second and opposite edge of such sheet; and (d) means for rotating said first member and said second member in said first position and said second position for buckling the liquid ink printed sheet downwardly through said first desired height distance, and through said cross-track distance "D3" onto said stacking surface of said output tray.

5. The mechanism of claim 4, wherein said edge guiding portion of said first member relative to said second member is formed at a distal point on said edge supporting position of said first member.

6. The mechanism of claim 4, wherein said edge guiding position of said second member, relative to said first member, is formed at a distal point on said edge supporting portion of said second member.

7. The mechanism of claim 4, wherein each said edge supporting portion of said first member and said second member includes a convex sheet edge supporting surface.

8. The mechanism of claim 7, wherein each said edge guiding position is formed at a distal point on each said convex sheet edge supporting surface.

9. A printing system comprising:

(a) a liquid ink printer including at least a printhead for printing liquid ink images on a sheet of paper having a flat, cross-track dimension "D1" defined by a first edge and a second and opposite edge of such sheet of paper;

(b) means for moving the sheet of paper along an in-track path and direction; and (c) a mechanism for supporting and stacking the liquid ink printed sheet so as not to smear or offset wet liquid ink images thereon, said mechanism including:

(i) an output tray defining a stacking surface for holding the liquid ink printed sheet in a stack;

(ii) a first member having an edge supporting portion and an edge guiding portion, said first member being mounted at a first position having a first desired height distance above said stacking surface, and said first member extending along the in-track path and direction, for supporting and guiding the first edge of the liquid ink printed sheet;

(iii) a second member having an edge supporting portion and an edge guiding portion, said second member being mounted at a second position having said first desired height distance above said stacking surface, and spaced a cross-track distance "D3" less than "D1" from said first member, and said second member extending along the in-track path and direction for supporting and guiding the second and opposite edge of such sheet; and (iv) means for rotating said first member and said second member in said first position and said second position for buckling the liquid ink printed sheet downwardly through said first desired height distance, and through said cross-track distance "D3" onto said stacking surface of said output tray.

* * * * *